United States Patent [19]

Boyadjieff et al.

[11] 3,990,508

[45] *Nov. 9, 1976

[54] REMOTELY OPERATED WELL SAFETY VALVES

[75] Inventors: George I. Boyadjieff, Woodland Hills; Ben A. Otsap, Encino, both of Calif.

[73] Assignee: Varco International, Inc., Orange, Calif.

[ * ] Notice: The portion of the term of this patent subsequent to Dec. 10, 1991, has been disclaimed.

[22] Filed: Aug. 22, 1974

[21] Appl. No.: 499,446

Related U.S. Application Data

[60] Division of Ser. No. 252,808, May 12, 1972, Pat. No. 3,853,175, which is a continuation-in-part of Ser. No. 203,142, Nov. 30, 1971, abandoned.

[52] U.S. Cl. ..... 166/72; 166/224 A; 251/294; 251/319

[51] Int. Cl.[2] ..... E21B 43/00

[58] Field of Search ..... 166/72, 73, 224 S, 226, 166/315; 251/228, 229, 251, 294, 319

[56] References Cited

UNITED STATES PATENTS

| | | | |
|---|---|---|---|
| 1,911,323 | 5/1933 | Otis | 166/224 |
| 2,207,033 | 7/1940 | Toney | 166/72 |
| 2,351,322 | 6/1944 | Crake | 166/72 |
| 2,357,189 | 8/1944 | Erwin | 166/224 |
| 3,351,133 | 11/1967 | Clark, Jr. et al. | 166/53 |
| 3,675,718 | 7/1972 | Kanady | 166/224 A |

*Primary Examiner*—James A. Leppink
*Attorney, Agent, or Firm*—William P. Green

[57] ABSTRACT

A safety valve to be lowered into a well and adapted to close off the flow of production fluid upwardly from the well, and which is operated by an actuating cable extending upwardly toward the surface of the earth, with the cable or other element being preferably maintained under tension and acting to hold the valve in open condition so long as the tensioned condition exists, but to release the valve for automatic closing movement in the event of breakage of the cable or release of its tensioned condition for any other reason. The safety valve includes a ball type valve element which moves downwardly in response to upward movement of the main actuating element, and is turned between open and closed conditions by such downward movement of the ball valve.

4 Claims, 22 Drawing Figures

116
94
13
19
20
10
11
15
12
65
18
33
17
24
16
14
133
37
15
71
80
79
73
38
74
75
76
72
77
78
43
41
39
42
40
30
28
31
29
164
63
64
69
26
67
27
32
17
59
25
12
60
48
21
47
22
49
24
61
23
70
46
15
71
45
44
18
135
34
35
33
12
133
94
106
96
111
112
106
103
101
102
100
105
104
95
108
107
98
99
97
109
110
13
92
91
89
182
90
19
87
82
84
81
85
86
88
20
83
70

Fig. 3
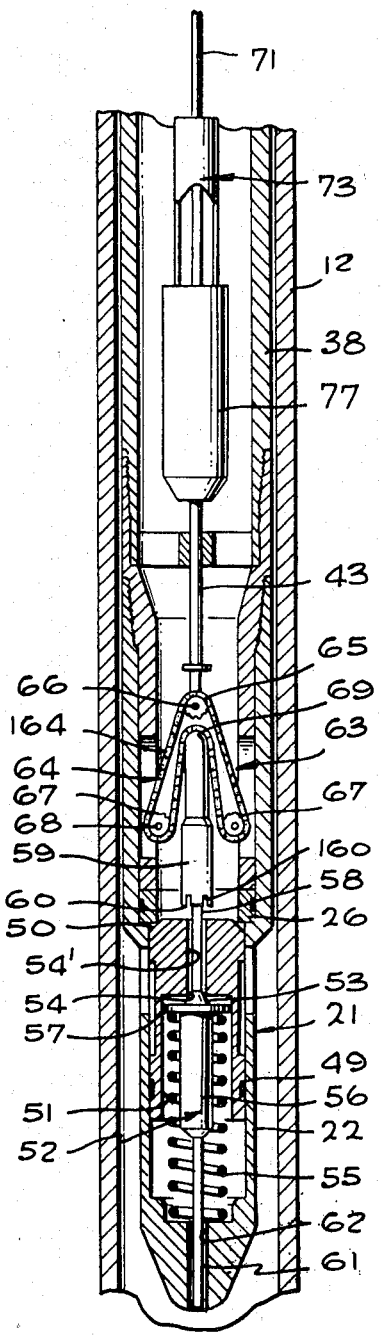
Fig. 4
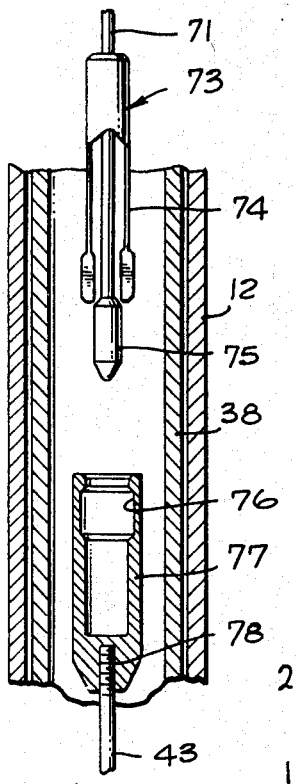
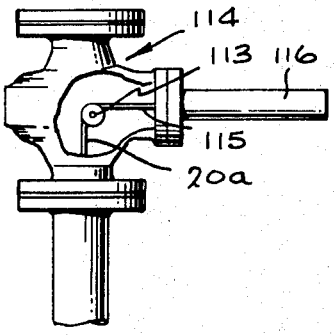
Fig. 5
Fig. 6
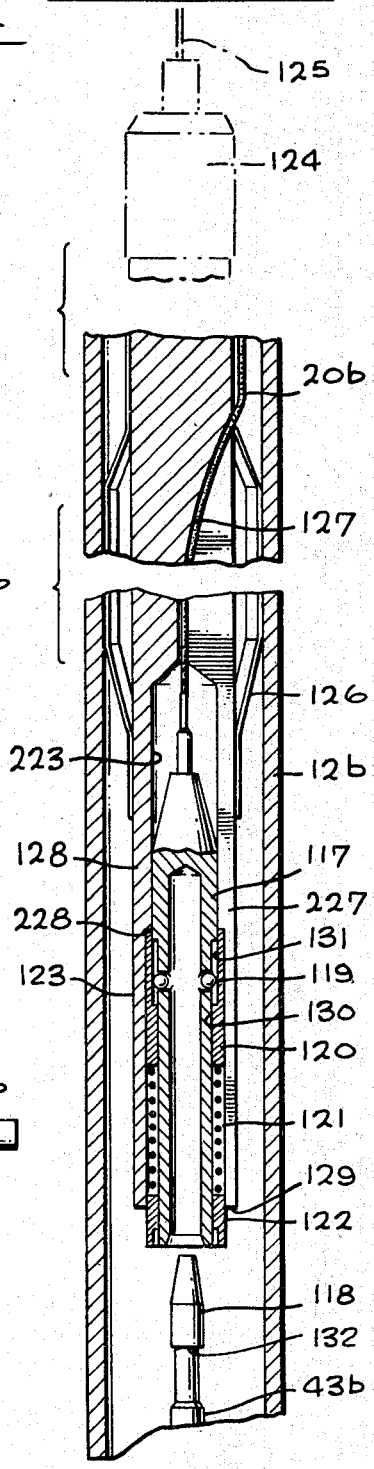

Fig. 13
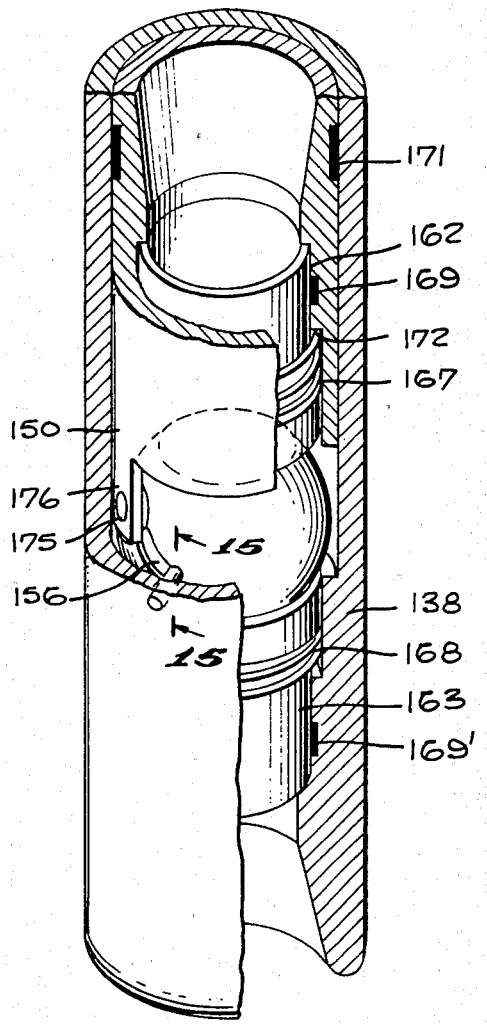
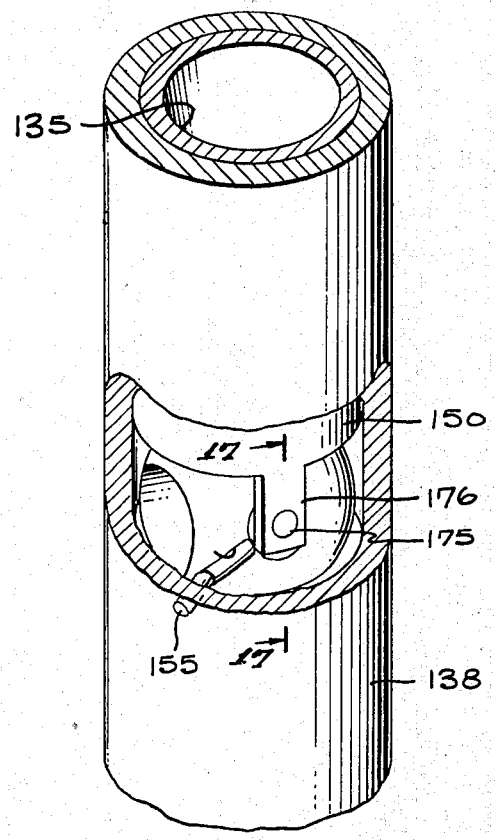
Fig. 14
Fig. 16
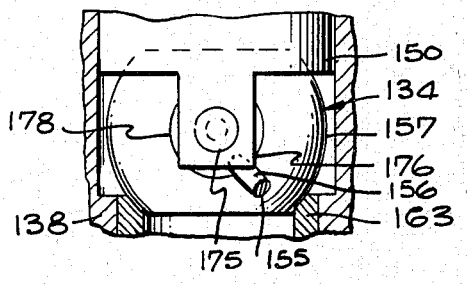
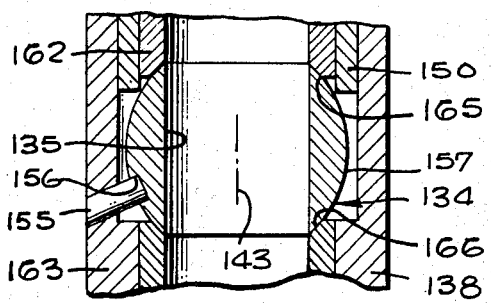
Fig. 15
Fig. 17
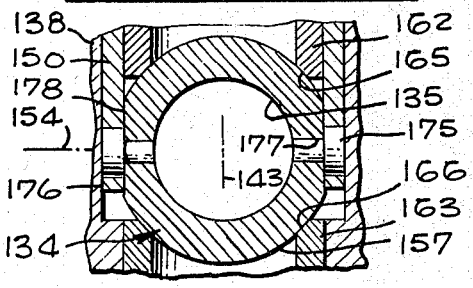

REMOTELY OPERATED WELL SAFETY VALVES

CROSS REFERENCE TO RELATED APPLICATION

This is a division of application Ser. No. 252,808, filed May 12, 1972, now U.S. Pat. No. 3,853,175, which was a continuation-in-part of application Ser. No. 203,142 filed Nov. 30, 1971, now abandoned.

BACKGROUND OF THE INVENTION

This invention relates to improved safety valves for closing off the flow of production fluid upwardly through a well in the event of failure of some of the well equipment.

In a producing well, it is highly desirable to provide some type of safety mechanism for closing off the flow of production fluid upwardly through the well and to the surface of the earth in the event of a rupture or leak in one of the lines conducting that fluid, or in the event of any other type of derangement which might release oil into the surrounding area in uncontrolled fashion. This is particularly true, for example, in the case of wells drilled under a body of water, in which case the escape of even small amounts of oil from the well may very seriously pollute the water. There have in the past been devised various types of safety valves for closing off the flow of production fluid from a well, but all of these prior safety valves of which we are aware are either relatively difficult to position in the well or to operate, or are not as positive as would be desired in closing off the fluid flow under any adverse conditions which may develop. Most such prior valves have been operated by fluid pressure from the surface of the earth, and have been constructed in a manner requiring removal of the tubing string from the well in order to permit installation of the safety valve therein.

SUMMARY OF THE INVENTION

The present invention provides a novel type of safety valve which can be very easily and quickly lowered to a point deep within a producing well, while the production tubing remains positioned in the well, and therefore in a manner avoiding the usual necessity for laborious removal and then replacement of the tubing during installation of the safety valve. Further, the valve is constructed to be remotely operated from the surface of the earth without the necessity for the usual hydraulic control line extending downwardly within the well to the region of the valve. In addition, the valve may be designed to respond automatically to any of numerous different changes in condition in or near the well, as for instance a change in pressure, temperature, or the like at the surface of the earth, or damage of any type to the well caused by surface storms, explosions, or other adverse conditions.

For controlling operation of the valve, there is provided an enlongated actuating unit, preferably a 'wire line' or other flexible cable, which extends downwardly from the surface of the earth and functions to control the valve in response to longitudinal movement of the elongated element. This element may, while the well is producing, be maintained in a longitudinally stressed condition, with the valve remaining open so long as that stressed condition exists. Optimally, the stressed condition is one of tension in which a pulling force exerted against the upper end of the cable is transmitted by the cable to the valve control mechanism to maintain the valve open. It is contemplated, however, that some features of the invention might be applicable also to an arrangement in which a nonflexible elongated element extending to the surface of the earth might be maintained under longitudinal compression rather than tension while the valve is open.

A piston and cylinder mechanism or other operating unit can be provided at the surface of the earth for developing and maintaining the stressed condition of the cable or other actuating element, in a manner such that either an intentional or unintentional reduction in fluid pressure or the like at the operating unit will release the stressed condition of the cable and close the safety valve. Further, if the cable or other actuating element is broken by any type of explosion or other derangement at the surface of the earth, or the longitudinal force is released in any other way, the valve will always function in fail-safe manner to close off the fluid flow until the adverse condition has been corrected.

The safety valve is of a type in which the valve element proper consists of a ball containing a passage through which the well fluid may flow in one condition of the valve but which is blocked off to a closed condition by pivotal or rotary movement of the ball to a predetermined closed position, with this rotary movement of the ball being controlled by actuation of the previously discussed vertically movable wireline of other actuating member. Upward movement of the actuating element causes downward movement of the ball, by virtue of a motion reversing unit, and the downward movement of the ball in turn induces its rotary motion between closed and open conditions.

BRIEF DESCRIPTION OF THE DRAWINGS

The above and other features and objects of the invention will be better understood from the following detailed description of the accompanying drawings in which;

FIG. 3 is a further enlarged view similar to a portion of FIG. 2, and showing the safety valve in closed condition;

FIG. 4 shows the cable attaching connection of FIG. 2 in separated condition;

FIG. 5 is a somewhat diagrammatic representation of a different type of operating unit for the FIG. 1 valve assembly;

FIG. 6 shows the manner in which the cable can be connected to the valve by conventional running equipment if desired;

FIG. 13 is an enlarged perspective view, partially broken away, showing the ball valve and related parts in the open condition of FIGS. 7 and 9;

FIG. 14 is a perspective view similar to FIG. 13 but showing the ball valve closed;

FIG. 15 is a vertical section taken on line 15—15 of FIG. 13;

FIG. 16 is a view taken essentially on line 16—16 of FIG. 9;

FIG. 17 is a fragmentary vertical section on line 17—17 of FIG. 14;

DESCRIPTION OF THE PREFERRED EMBODIMENTS

Figures 1, 2:
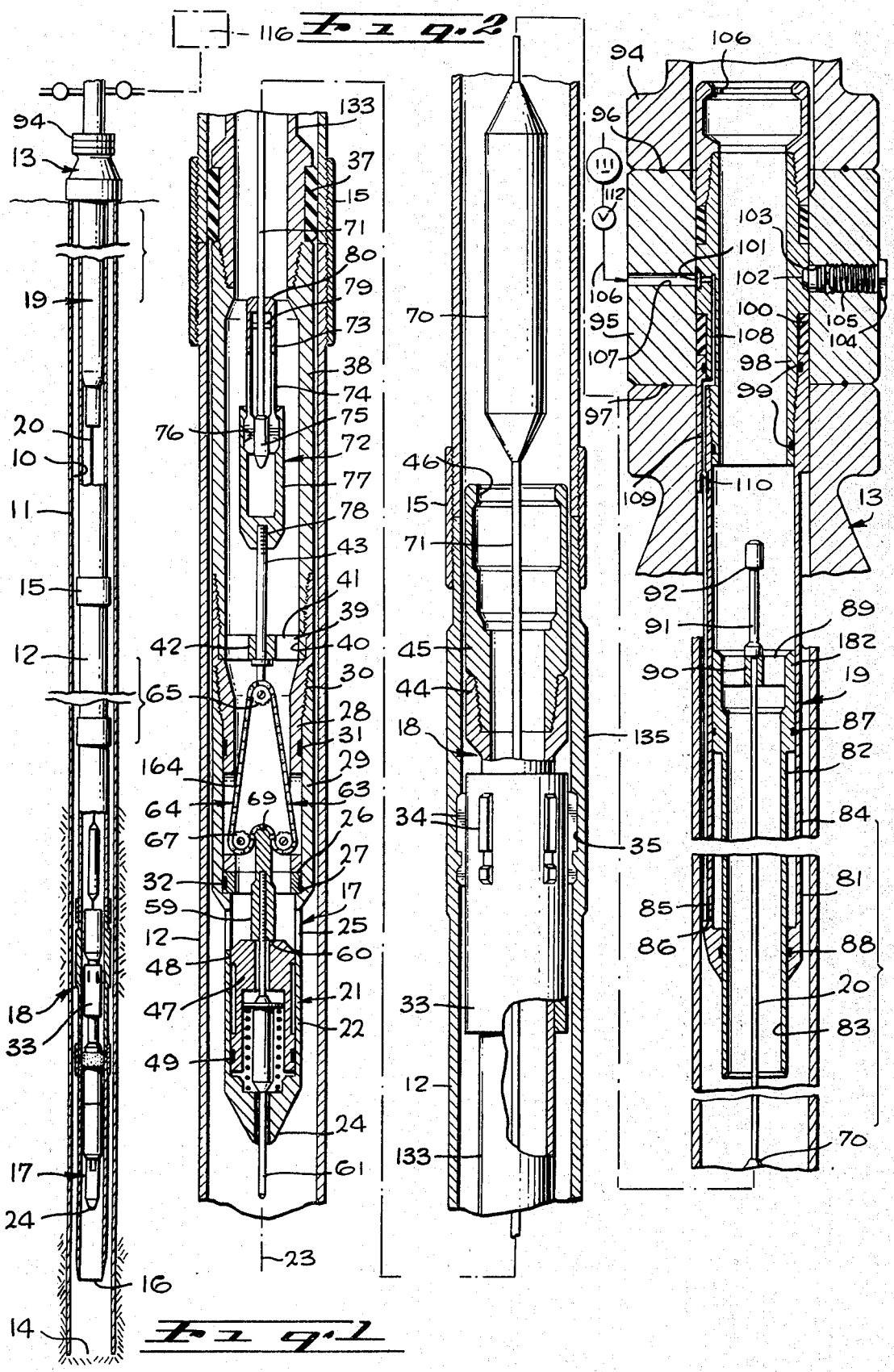
FIG. 1 is a diagrammatic representation of a producing oil well containing a first form of remotely operated safety shut-off valve, which is covered in our above identified parent application Ser. No. 252,808 of which the present application is a division.
FIG. 2 is an enlarged vertical or axial sectional view showing the main operative portions of the apparatus of FIG. 1, illustrated in three partial views which are continuations of one another.

With reference first to FIG. 1, I have illustrated diagrammatically in that figure a well 10 having the usual casing 11 and containing within the casing an essentially conventional string of prodction tubing 12 extending downwardly from well head 13 to a location near the production zone 14. The tubing string is formed of a series of tubing sections interconnected in end-to-end relation by internally threaded couplings 15, and with the lower end 16 of the tubing being open to upward flow of oil or other production fluid into the interior of the tubing and out its upper end to a storage tank 116 or distribution line. A safety valve unit 17 is positioned within the tubing, desirably near its lower end, and is adapted to be located in the tubing and sealed with respect thereto by a landing and sealing unit 18, which may either be constructed integrally with valve unit 17 or be a separately formed and attached conventional landing and sealing unit. The safety valve is controlled by an elongated flexible cable 20, desirably of the type commonly referred to as a 'wireline', which cable extends upwardly to the surface of the earth and is controlled at that location by a suitable manually actuated or power actuated operating mechanism represented at 19 in the drawings.

To describe now the structure of the valve unit 17 in detail, this unit includes a lower body section 21 having a tubular vertical side wall 22 centered along vertical axis 23 of the well and terminating downwardly in a closed externally rounded lower nose portion 24. At 25, the side wall 22 of lower body section 21 contains a series of circularly spaced apertures through which production fluid can flow inwardly into the interior of body section 21 and then upwardly through an annular valve seat element 26 which is held downwardly against a shoulder 27 by engagement with the lower annular end surface of a tubular second body section 28 contained within the upper soemwhat enlarged diameter tubular portion 29 of the first body section 21. The two body sections may be secured tightly together by threads 30, with an annular fluid tight seal being formed therebetween at 31, and with seat 26 being sealed with respect to body section 21 by an annular seal element 32.

The landing and sealing unit 18 is connected to the upper end of the valve body structure 21–28, and is typically and somewhat diagrammatically illustrated as of a well-known conventional 'key-type' having a tubular mandrel 33 disposed about a tubular body 133 and movably carrying a number of locating keys or dogs 34 contoured to fit into a mating locating groove or plurality of grooves 35 formed in a coacting tubular landing nipple or collar 135 connected into the string of tubing 12. When set, unit 18 holds the valve positively in the position illustrated in FIG. 2. In accordance with known teachings, keys 34 may be spring pressed radially outwardly within apertures formed in mandrel 33, to automatically move outwardly into groove 35 when they reach the location of the groove. After such outward movement the keys are locked in these outer holding positions in conventional manner by predetermined manipulation of body 133 from the surface of the earth, as for instance by a rapid vertical jarring of body 133 acting to shear a connection between body 133 and mandrel 33 and move a locking or camming portion of the body into a position behind or radially inwardly of the keys. After being set in this way, the keys and related parts very positively hold mandrel 33 and body 133 against both upward and downward movement relative to nipple 135. In lieu of this key-type landing device typically illustrated in FIG. 2, the landing equipment may be of any other conventional type, such as for example a type having slips adapted to be forced outwardly against the tubing in frictional holding relation, or having lugs which are receivable between the ends of successive lengths of the tubing 12, and in each case functioning to hold the valve in a fixed vertical position.

The landing and sealing unit 18 also carries an appropriate annular seal ring 37 of rubber or the like, adapted to annularly engage the inner surface of nipple 135 in a relation forming an effective annular seal between the tubing and body 133, to thus prevent upward flow of any of the production fluid between these parts. The lower end of body 133 may be connected threadedly to the upper end of a tubular adapter 38, with seal ring 37 being clamped between shoulders on these two parts. The lower end of adapter 38 may be threadedly connected in turn of the upper end of valve body section 28, and may clamp a fluid passing spider 39 in position between the lower end of adapter 38 and the upper end of element 28, as shown. This spider 39 has circularly spaced fluid passing apertures 40, with webs 41 extending radially between these apertures and carrying a central bushing or guide element 42 slidably receiving a later-to-be-described guide rod 43 movable vertically along axis 23. The upper end of body 133 may be threadedly connected at 44 to a tubular fitting 45 having an annular shoulder 46 at its upper end which is engageable by a conventional fishing tool to enable upward removal of the valve assembly from the tubing when desired.

For closing off the upward flow of fluid through the apparatus of FIG. 2, the valve assembly 17 includes a valve element 47 which has outer cylindrcal surfaces 48 engaging the inner cylindrical surface of body wall 22 to guide valve element 47 for only upward and downward movement within body section 21 along axis 23. Near its lower end, the valve element 47 is sealed with respect to side wall 22 by means of an annular seal ring 49. The upper annular conically tapering surface 50 on element 47 is engageable with valve seat 26 in the FIG. 3 closed position of the valve, to positively and effectively block off any upward flow of the fluid past the seat and into the interior of the upper portion of tubing 12.

Valve element 47 contains a downwardly opening typically cylindrical chamber 51 within which there is received a bleed valve element 52 having an annular tapered valve surface 53. engageable annularly in sealing relation with a valve seat surface 54 formed in element 47 at the lower end of a vertical typically cylindrical bleed passage 54'. A coil spring 55 disposed about the enlarged portion 56 of bleed valve element 52 acts against a flange 57 to urge the bleed valve upwardly relative to the valve body and relative to the valve element 47 and toward the closed-valve highest position of FIG. 3. In that FIG. 3 position, valve surface 53 is held tightly against seat surface 54 in sealing relation effectively preventing the upward leakage of any pressure fluid from within chamber 51 through passage 54' to the upper side of valve element 47.

A rod 58 extends upwardly from bleed valve 52, and is rigidly connected by threads or otherwise to an enlarged head element 59 at the upper side of element 47, with this head element having a downwardly facing shoulder 60 engageable with the upper surface of valve element 47 to displace it downwardly toward the FIG. 2 open position of element 47. Rod 58 has an outside diameter smaller than the internal diameter of passage 54', to allow relatively free fluid flow vertically through passage 54' between the underside and upper side of element 47 in the open condition of bleed valve 52, with head 59 containing suitable notches 160 interrupting shoulder 60 to permit fluid flow upwardly therepast even when the shoulder is in engagement with valve 47. The lower end of bleed valve 52 carries a downwardly projecting second rod 61, which like rod 58 is centered about and extends along axis 23, and which extends through a vertical cylindrical passage 62 formed in the lower end of body section 21. Rod 61 is spaced from the wall of passage 62 in a manner leaving a substantial clearance for upward flow of pressure fluid from the underside of body section 21 to the interior of chamber 51. However, the transverse area of the clearance space about rod 61 is not as great as the effective minimum transverse area of the clearance space about the upper rod 58, and through notches 160, so that upon opening of valve element 52 the pressure from chamber 51 can be bled rapidly to a value approximately equalling the pressure at the upper side of element 47, while the gap about rod 61 is too restricted to permit enough flow to prevent this drop in pressure.

The element 59 and its connected bleed valve 52 are actuated downwardly in response to upward movement of rod 43 and tensioning cable 20, through a mechanical reversing mechanism 63. This mechanism includes an endless flexible chain 64 whose upper end extends about a small roller 65 mounted to the lower end of rod 43 for rotary movement about a horizontal axis 66. The two generally vertical runs 164 of this chain flare progressively apart as they extend downwardly from upper roller 65, to pass about two spaced lower rollers 67 which are mounted appropriately to body section 28 for relative rotary movement about two spaced parallel horizontal axes 68 at opposite sides of element 59. After passing about the rollers 67, chain 64 is extending between those rollers extends across the upper rounded end 69 of element 59, and is appropriately located thereon in a manner preventing it from slipping off of end 69, so that as rod 43 moves upwardly between the FIG. 3 and FIG. 2 positions, the portion of chain 64 between the two rollers 67 is automatically reduced in length to force element 59 and the connected bleed valve 52 downwardly between its FIG. 3 and FIG. 2 positions. After the initial opening movement of the bleed valve, further downward movement of element 59 causes shoulder 60 to engage the upper horizontal surface of valve element 47, and thereby force that valve element downwardly. As will be understood, the initial opening movement of the bleed valve allows the high pressure from the underside of valve element 47 to bleed upwardly through passage 54' to its upper side and thereby equalize the pressure at the top and bottom of element 47 in a manner preventing the well pressure from resisting opening movement of the main valve.

The upward pulling force exerted on cable 20 from the surface of the earth is transmitted to rod 43 through a vertically extending landing weight 70, which carries a typically rigid depending rod 71 extending along axis 23. At its lower end, rod 71 may be detachably connectible to rod 43 by a connection 72, including a generally tubular connector element 73 disposed about the lower end of rod 71 and having circularly spaced fingers 74 which are expansible to the FIG. 2 locking position by movement upwardly into these fingers of an enlarged lower end 75 of rod 71. The fingers when expanded are received within an annular internal groove 76 formed in a mating hollow connector part 77 which is threadedly connected at 78 to the upper end of rod 43. When the cable 20 is initially lowered into the well, lower enlarged end 75 of rod 71 is in the FIG. 4 position of projection downwardly beyond element 73, so that fingers 74 are held inwardly in their FIG. 4 positions by virtue of the resilience of element 73, until element 73 has been moved downwardly into the interior of the socket element 77, following which rod 71 and its portion 75 can be pulled upwardly to the FIG. 2 setting to lock the two connector parts together. A transverse shear pin 79 may extend through a transverse opening in rod 71 beneath an upper internal flange 80 of element 73, so that by forced upward movement of rod 71 shear pin 79 can be broken and enlargement 75 can thus be withdrawn upwardly from within fingers 74, allowing those fingers to contract inwardly and release the connection between cable 20 and the valve mechanism.

The apparatus 19 at the surface of the earth for actuating cable 20 includes a tubular hydraulic cylinder element 81 (FIG. 2), containing a tubular piston element 82, in a manner leaving an open vertical fluid flow passage 83 within the interior of the piston. The annular cylinder chamber 84 receives pressure fluid through a small supply line 85 connecting into the lower end of the annular chamber at 86, to force piston 82 hydraulically upwardly relative to cylinder 81 is response to the introduction of pressure fluid into chamber 84. The piston and cylinder are sealed annularly with respect to one another at 87 and 88. The upper enlarged diameter portion 182 of the piston carries a fluid passing spider 89 which mounts a central tubular element 90 through which the upper end of cable 20 extends for connection to a rigid upper end member 91 which bears downwardly against portion 90 to restrain the cable against downward movement. The upper enlarged head 92 of element 91 acts as a fishing neck, for engagement with a fishing tool to withdraw the cable upwardly if desired.

In FIG. 2, the conventional well head is represented at 13, and the lower portion of the main flow control valve assembly or 'Christmas tree' is represented at 94. The piston and cylinder mechanism 81-82 is desirably suspended from an annular adapter flange 95 which is located vertically between the flanges of the well head 93 and valve assembly 94, and is suitably secured in any convenient manner thereto, with appropriate annular sealing as represented at 96 and 97. To effect this suspension, the upper end of cylinder 81 may be secured threadedly to a vertical supporting tube 98, appropriately sealed with respect to the cylinder at 99, and with respect to flange 95 at 100. The outer surface of tube 98 may have an annular groove 101 within which a number of circularly spaced locking dogs 102 are receivable in the FIG. 2 relation effectively supporting element 98 and the connected piston and cylinder mechanism in fixed position relative to the well head. The dogs 102 may be mounted for radial movement within guideways 103, and are actuable radially inwardly and outwardly by locking elements 104 which may be threadedly connected to the flange at 105. The upper end of element 98 may carry a fishing neck 106 which is engageable with an appropriate fishing tool to enable removal of the unit 19 upwardly from the well when desired. Pressure fluid is delivered to tube 85 from an inlet line 106 connecting into a passage 107 in flange 95, which passage communicates with the upper end of a passage 108 in part 98, and then through a passage 109 in part 81 with the upper end of tube 85 at 110. The pressurized hydraulic fluid for actuating piston 82 may be delivered to line 106 from an appropriate pressure source 111 (FIG. 3) under the control of a three way valve 112 which can selectively either apply or release the piston actuating pressure. It is contemplated that this valve 112 may be controlled automatically by any desired response mechanism associated with the well, to apply or release the pressure automatically in response to a predetermined change in condition, and/or the valve may be operated manually.

In installing the safety valve apparatus of FIGS. 1 to 4 in a well, the valve assembly 17 and connected landing and sealing assembly 18 are first of all lowered into the well separately from cable 20 and its connected weight 70, rod 71, and element 73. This valve and landing assembly 17-18 can be lowered by conventional wireline running equipment engaging the upper shoulder 46 on the apparatus. The valve is lowered to a position near the bottom of production tubing 12, as illustrated in FIG. 1, or just above the well pump if a pump is provided, and to a position in which locating keys 34 move outwardly into grooves 35, and the running equipment is then actuated in conventional manner to lock keys 34 in those grooves. If slips or other movable gripping elements are employed, the running mechanism is appropriately actuated to set the slips or the like in holding position against the tubing wall or between spaced ends of two lengths of tubing, etc. Thus, the valve is effectively located in positively fixed position and is sealed with respect to the tubing 12, so that production fluid can flow upwardly through the tubing only if valve 47 is open.

After the valve and landing equipment have thus been lowered into and located within the well, cable 20 and the connected weight 70, rod 71 and element 73 are lowered into the well, with element 73 in the upwardly retracted relative position of FIG. 4, until the lower enlarged end 75 of rod 71 enters socket element 77 and fingers 74 are received within groove 76 in the socket element, after which the cable and rod 71 are pulled upwardly to expand the fingers outwardly and lock them in holding engagement with the socket. During the final portion of the downward movement of the cable, the cylinder 81, piston 82, and connected parts at the upper end of the cable are lowered downwardly to their FIG. 2 positions, and are suspended from flange 95 in those positions by radially inward tightening of locking dogs 103.

During this installing procedure, valve 47 will normally be in closed position, and bleed valve 52 will normally be urged upwardly against seat 54 as illustrated in FIG. 3. When it is desired to place the well in production, pressure fluid is applied to piston 82 through line 106 of FIG. 2, to force the piston upwardly relative to cylinder 81, and thereby displace the upper end of cable 20 upwardly to the FIG. 2 position. The initial portion of this upward movement of the cable causes bleed valve 52 to open against the force of spring 55, and bleed pressure from the underside of the piston upwardly in a manner equalizing the pressure at the top and bottom of the piston and allowing element 59 on further downward movement to very easily displace piston 47 to its FIG. 2 fully opened position. The location of shoulder 60 at the lower end of element 59 is such as to allow for sufficient lost motion between element 59 and piston 47 to permit the indicated opening of bleed valve 52 before commencement of the downward movement of main safety valve 47.

After valve 47 has thus been actuated to its fully opened FIG. 2 position, the piston 82 is subsequently, under normal operating conditions, maintained continually under pressure, to thereby keep wireline 20 in its longitudinally tensioned condition, retaining valve 47 open, and thus allowing free upward flow of production fluid through the tubing and to the surface of the earth. If at any time this pressure to the piston is cut off, as by closing of valve 112, either manually or in automatic response to a predetermined change of condition or conditions in the well equipment, or by rupture of line 106 or any connecting line, or failure of the pressure source 111, piston 82 is immediately permitted to return downwardly to its initial position and thereby relieve the tensioning force on cable 20, and permit return of valve 47 to its FIG. 3 closed position. The initial upward movement of element 59 upon downward releasing movement of cable 20 enables bleed valve 52 to close against seat 54, after which the restricted communication of pressure to the interior of chamber 51 through the clearance space about lower rod 61 is sufficient to build up a high pressure within chamber 51 and at the underside of piston valve 47 approximately equalling the well pressure, thus causing upward movement of valve 47 against the lower pressure at its upper side and to the FIG. 3 setting. Similar closing of the valve is automatically attained if the tensioned cable 20 is broken in any way, as for instance by an explosion or other damage occurring at the surface of the earth or elsewhere. The apparatus thus effectively prevents unwanted flow of production fluid into the tubing under virtually any adverse condition which may develop.

FIG. 5 shows diagrammatically a variational arrangement, which may be considered the same as that of FIGS. 1 to 4 except for the manner in which operating tension is applied to the upper end of cable 20*a*. Specifically, in FIG. 5, the cable after extending upwardly from the valve 17 and landing and sealing assembly 18 of FIG. 2 passes about a pully 113 which is mounted in the well head equipment 114 to turn about a horizontal axis, with the cable then extending horizontally at 115 for connection to any conventional type of manually actuated or power actuated operating mechanism represented at 116. This unit 116 may for example be a hydraulicly actuated operator of the type conventionally employed for opening and closing gate valves in well head equipment. The unit 116 applies tension force to cable 20*a*, and maintains the cable under such tension continually while the well is producing, and until a manually or automatically operated control element releases the tension and permits closing of the valve.

FIG. 6 illustrates another way in which the cable 20b (corresponding to cable 20 of FIGS. 1 to 4) can be attached to the upper end of a rod 43*b* corresponding to rod 43 of FIG. 2. More particularly, the cable 20*b* of FIG. 6 may have a socket element 117 at its lower end for receiving an enlarged head 118 attached to the valve actuating rod 43*b*, with circularly spaced balls 119 being contained within openings in the side wall of element 117 and adapted to be actuated inwardly to positions of holding engagement with the underside of head 118 by relative upward movement of a locking tube 120 under the influence of a spring 121, whose lower end bears against a ring 122 which is fixed with respect to the side wall of socket element 117. The element 117 is lowered by and within a part 123 connected to a conventional running element 124 suspended from a running wireline 125. Externally, part 123 may have bowed springs 126 engageable with the side of the tubing 12*b* to maintain element 123 in centered position. The operating wireline of the present apparatus 20b extends upwardly through a cutaway recess 127 formed in one side of element 123, which recess continues downwardly as an elongated vertical slit 227 through the side wall 128 of part 123 and to its lower end 129, so that element 123 can be pulled upwardly away from part 117 and wireline 20b after lowering these parts into the well.

During the lowering of element 123 into the well, elements 117 and 120 are received within the socket recess 223 in part 123, but element 117 is held downwardly far enough relative to part 120 by spring 121 to cause balls 117 to engage the reduced diameter surface 130 of element 120. When the parts reach rod 43b, element 117 moves downwardly about that rod, and balls 119 may be simultaneously released by exertion of upward pulling force against cable 20b to actuate the balls to a released position of engagement with enlarged diameter surface 131 in element 120, so that the retracted balls can move downwardly past head 118. When this upward force is exerted against cable 20*b*, element 123 acts through a shoulder 228 to force element 120 downwardly relative to part 117 and balls 118 and against the influence of spring 121. Upon subsequent release of cable 20*b*, element 120 is spring actuated upwardly to bring surface 130 into engagement with balls 119, and thus deflect the balls radially inwardly at the underside of head 118 for retaining engagement with bottom shoulder 132. The cable 20*b* is in this way connected to the valve actuating mechanism, and the running line 125 and connected element 123 can then be withdrawn upwardly out of the well, so that cable 20*b* may be tensioned and utilized to operate the valve in the manner previously discussed.

Figure 7:
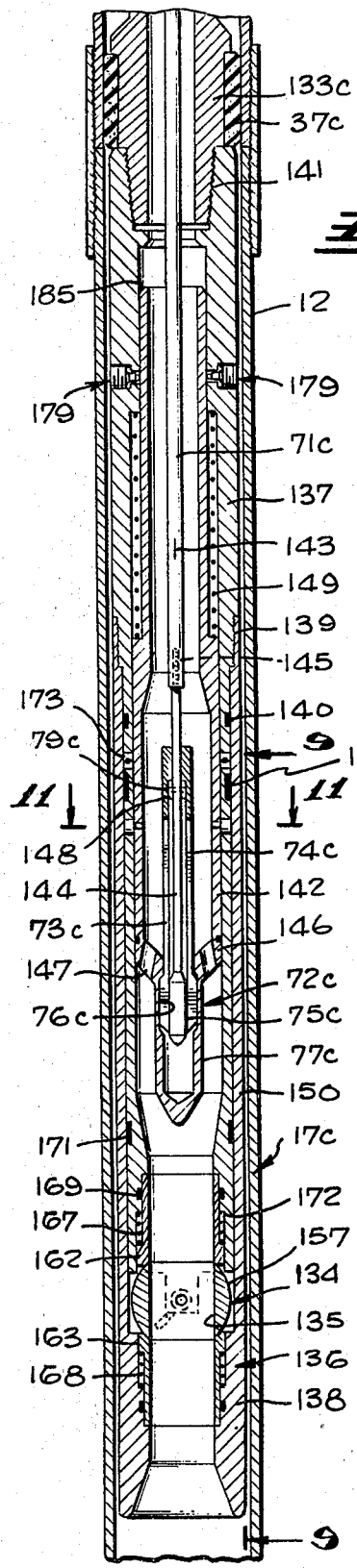
FIG. 7 is a view similar to the left-hand portion of FIG. 2, showing another type of safety valve assembly which may be substituted for the valve of FIG. 2, and which is covered in another division of parent application Ser. No. 252,808.

FIGS. 7 through 17 show another form of safety valve assembly which is covered in another divisional application, and in which the valve element proper takes the form of a pivotally or rotatively movable ball valve 134 containing a fluid passage 135. With particular reference to FIG. 7, the apparatus there shown may be substituted for the mechanism shown in the left one-third of FIG. 2, and may be considered as connected to and utilized in conjunction with the landing and sealing mechanism 18, operating mechanism 19, cable 20, head 13, and the other apparatus and parts shown in the right two-thirds of FIG. 2 and related views, or by any other suitable landing and actuating structures.

The outer body or housing 136 of the assembly shown in FIG. 7 may be formed of two upper and lower rigid tubular body parts 137 and 138 secured together by threads 139 which are annularly sealed at 140. At its upper end, body part 137 is threadedly connected at 141 to the lower end of a part 133c corresponding to element 133 of FIG. 2, to thereby secure the valve assembly to the lower end of the landing and sealing unit 18 of that figure. An annular packer 37*c* in FIG. 7 is disposed about element 133*c* and corresponds to sealing element 37 of FIG. 2, to form an annular seal at that location between the tool and the well tubing 12 within which it is contained. A rod 71*c* in FIG. 7 corresponds to rod 71 of FIG. 2, and is connected at its upper end to landing weight 70 and thereabove to flexible wireline 20.

Rod 71c is connected to a tubular vertically extending member 142 which is contained within tool body 136 and is centered about the vertical axis 143 of the tool body and the production tubing 12. This attachment is effected by means of a releasable connection or 'disconnect' 72c which is structurally very similar to the disconnect 72 of FIG. 2. More particularly, connection 72*c* may include a tubular element 73c disposed about a vertical rigid rod 144 which is threadedly connected at 145 to the lower end of rod 71c and forms a lower continuation thereof. Element 73*c* forms a series of circularly spaced vertical gripping fingers 74*c*, which are expansible to their FIG. 7 locking positions by reception therein of an externally cylindrical lower portion 75*c* of element 144, and in that locking position are received within an annular groove 76*c* formed in a hollow bottom connector part 77*c* which is rigidly connected to the lower end of tube 142 by a spider arrangement 146 containing apertures 147 through which the well fluid may pass the disconnect. A shear pin 79*c* extends transversely through registering apertures in rod 144 and a sleeve 148 thereabout, to exert upward force on the disconnect and tube 142 through the shear pin except when excessive force is exerted upwardly on the rod 71*c* to purposely break the pin and allow removal of the cable 20 separately from the valve mechanism.

Figure 8:
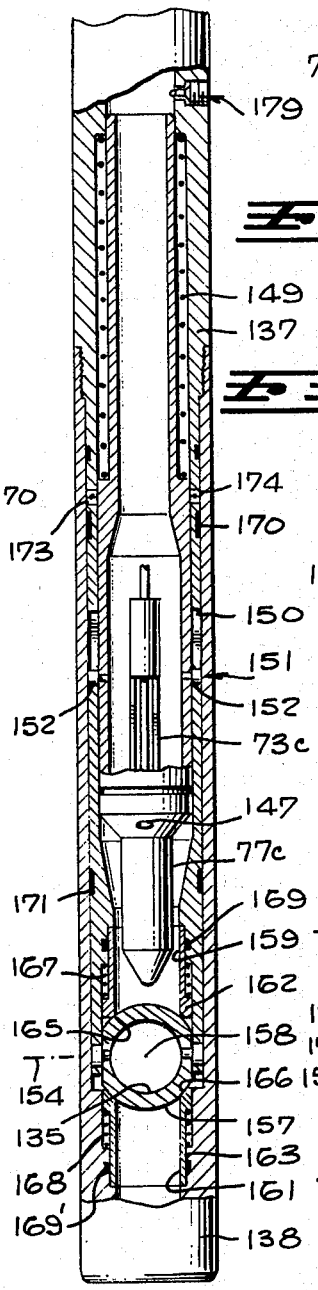
FIG. 8 shows the valve of FIG. 7 in closed condition.
Figure 11:
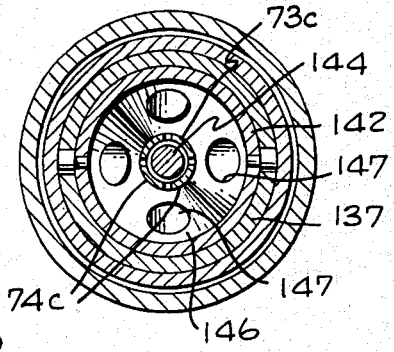
FIG. 11 is an enlarged horizontal section taken on line 11—11 of FIG. 7.
Figure 12:
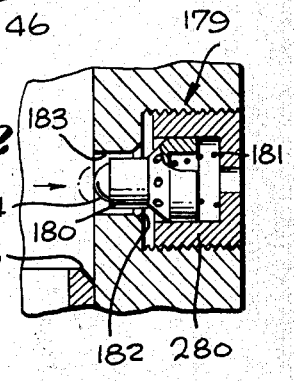
FIG. 12 is a greatly enlarged vertical section through the pressure equalizing valve of FIG. 8.
Figure 9:
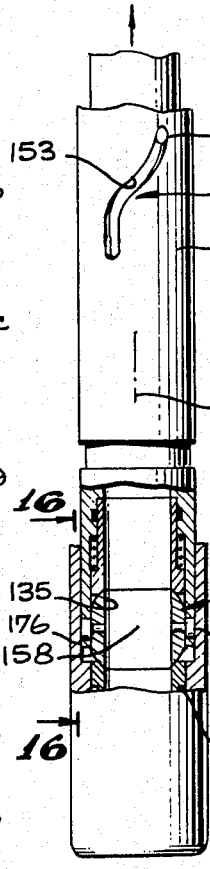
FIG. 9 is a fragmentary view taken partially on line 9—9 of FIG. 7, but broken away to reveal various inner parts of the tool.
Figure 10:
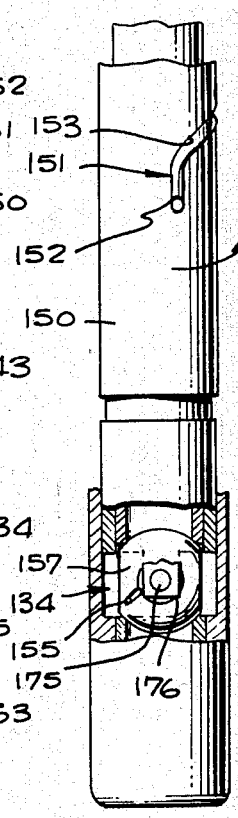
FIG. 10 is a view similar to FIG. 9 but showing the safety valve in closed condition.

Tube 142 is yieldingly urged downwardly within and relative to tool body 136 by means of a coil spring 149, which tends to return the tube and connected parts downwardly to the FIG. 8 closed position of the valve. Vertical movement of tube 142 is converted to rotary movement of another rigid tube 150 disposed thereabout by means of a camming mechanism 151, including a pair of camming pins 152 projecting radially outwardly from tube 142 at diametrically opposite locations and received within two cam slots 153 formed in tube 150 and having the configuration illustrated in FIG. 9. As will be apparent, in the lowermost FIGS. 8 and 10 position of tube 142, the camming pins 152 are received in the lower ends of cam slots 153, while in the uppermost position of tube 142 (FIGS. 7 and 9), the cam pins are received in the upper ends of the cam slots. Thus, vertical movement of tube 142 relative to tube 150 causes rotary movement of tube 150 relative to tube 142 about vertical axis 143 through a predetermined angular distance, say for example about 60°.

This rotary motion of tube 150 about vertical axis 143 is converted to pivotal or rotary movement of ball valve 134 about a horizontal axis 154 by means of a pin 155 which is rigidly carried by and projects generally radially inwardly from a side wall of lower body part 138, and which is received within a recess 156 formed in the outer surface of ball 134. To describe the ball valve 134 more specifically, this valve has an outer surface 157 which is spherical about a center 158 lying at the intersection of vertical axis 143 and the horizontal pivotal axis 154 of the ball. The previously mentioned passage or bore 135 extending through ball 134 may be cylindrical and of a diameter corresponding to cylindrical bores or passages 159 and 161 formed in two tubular valve seat elements 162 and 163 at the upper and lower sides respectively of the valve element. Upper seat element 162 has an annular spherically curved seat surface 165 annularly engageably with cylindrical surface 157 of the ball, while lower seat element 163 has a correspondingly spherically curved seat surface 166 also engageably annularly with valve surface 157. Seat element 162 is yeildingly urged downward relative to tube 150 by a coil spring 167 and is sealed annularly with respect to tube 150 by a ring 169 of rubber or the like. Similarly, lower seat element 163 is urged upwardly relative to body part 138 by a spring 168, and is sealed by a seal ring 169'. Tube 150 is sealed externally with respect to body part 138 by two annular seal rings 170 and 171. Spring 167 exerts downward force against seat element 162 and upward force against tube 150 by engagement with a shoulder 172 thereon, while spring 168 exerts upward force against seat element 163 and downward force against outer body 138, so that the overall effect is to hold the seats tightly against ball 134, and to urge tube 150 upwardly against a thrust bearing 173 which engages a downwardly facing shoulder 174 at the lower end of upper body section 137. Thus, the entire assembly consisting of tube 150, ball 134, and seat elements 162 and 163 is retained against any substantial vertical movement within the tool body, while permitting rotation of these parts about vertical axis 143 under the influence of the previously discussed cam mechanism 151.

The ball 134 is mounted for its limited pivotal movement between the FIG. 7 and FIG. 8 positions by means of two cylindrical mounting pins or stub shafts 175 which are carried rigidly by two downwardly projecting mounting arms 176 formed by tube 150 at diametrically opposite sides of the ball, with the inner reduced diameter portions of pins 175 being received in bearing engagement within openings 177 formed in the opposite sides of the ball. At the locations of mounting arms 176, the ball 134 may have two parallel opposite side flats 178, abutting against arms 176, to confine the ball against movement of any type except rotatively about axis 154.

In using the ball type valve assembly of FIGS. 7 through 17, that assembly and the connected landing and sealing unit 18 of FIG. 2 are lowered into the well in the same manner discussed in connection with the FIG. 2 apparatus, and at a predetermined location in the well the landing mechanism is actuated to lock that mechanism in fixed and sealed condition therein. The cable 20, landing weight 70, rod 71c, and connector elements 144 and 73c are then lowered into the well and connected to the valve assembly as in FIG. 7. The actuating equipment near the surface of the earth as seen in FIG. 2 is connected to the upper end of the cable, and is actuated to pull the cable upwardly and hold it in tensioned condition. The upward movement of the cable pulls tube 142 upwardly from the FIG. 8 position to the FIG. 7 position, and acts through cam mechanism 152-153 to cause rotation of tube 150 about vertical axis 143, which in turn acts through pin 155 to cause rotary movement of ball valve 134 about horizontal axis 154 from its FIG. 8 closed position to its FIG. 7 open position in which well fluid may pass upwardly without substantial restriction through the interior of the ball and to the surface of the earth. If at any time the cable 20 is broken or its tension is in any way released, as in the event of damage to the surface equipment or release of the tensioning fluid pressure at the surface of the earth, tube 142 is immediately and automatically acduated downwardly by spring 149 to its FIG. 8 position, to cam lower tube 150 in a reverse rotary direction, and thereby actuate valve element 134 about its horizontal axis 154 to the FIG. 8 closed position, in which both of the seat elements 162 and 163 engage the ball annularly about passages 159 and 161 and about imperforate portions of the ball to positively close off the flow of well fluid upwardly past the ball.

In order to equalize the pressure at opposite sides of the valve 134 as that valve is opened upon upward tensioning of cable 20, there may be provided in the side wall of upper body section 137 one or more equalizing valves 179 (FIG. 12), each of which may include a valve element 180 which is yieldingly urged radially inwardly relative to a threadedly mounted backing element 280 by a spring 181 and against a valve seat 182 to normally prevent the flow of well fluid inwardly through an opening 183 to the interior of body 137. At its inner end, this valve element 180 may have a tapering portion 184 which projects inwardly into the path of the upper edge portion 185 of tube 142, to be deflected radially outwardly by that edge against the tendency of spring 181 from the broken line closed position of FIG. 12 to the full line open position, upon the initiation of upward movement of tube 142. Thus, as soon as the tube is pulled slightly upwardly by the cable, the equalizing valve or valves 179 are opened, to equalize the pressure at opposite sides of the ball valve 134 and thereby facilitate opening movement of the ball valve and the related parts.

FIGS. 18 through 22 show the particular type of safety valve arrangement 17d which is covered by the claims of the present divisional application. In those figures, the valve element proper 187 takes the the form of a ball valve similar to that of FIGS. 7 to 17, but is actuable vertically rather than rotatively to open and close the valve. The outer body 188 of the FIGS. 18 to 22 tool may be formed of three rigid tubular body sections 189, 190, and 191 secured together by threads 192 and 193 and sealed annularly adjacent the threaded connections by seal rings 194 and 195. The upper end of top body section 189 is connected to the lower end of a landing and sealing unit such as that shown at 18 in FIG. 2, by attachment to a member 133d corresponding to element 133 of FIG. 2, with a seal ring 37d being provided for annular sealing engagement with the inner wall of production tubing 12. Cable 20 and landing weight 70 of FIG. 2 are connected through rod **71*d* to a vertically movable tube 196 through a releasable connection 72*d* constructed essentially the same as disconnect 72c of FIG. 7. The tube 196 is yieldingly urged downwardly by a spring 149*d* corresponding to spring 149 of FIG. 7, and carries one or more (typically two) camming pins 152*d* which are received within camming slots 153*d* in a cam tube 197 which is confined axially and retained for only rotary motion about vertical axis 143*d* by engagement at its opposite ends with two bearing sleeves 198 and 199 engaging the lower end of body section 189 and a shoulder 200 of body section 190** respectively.

Figure 20:
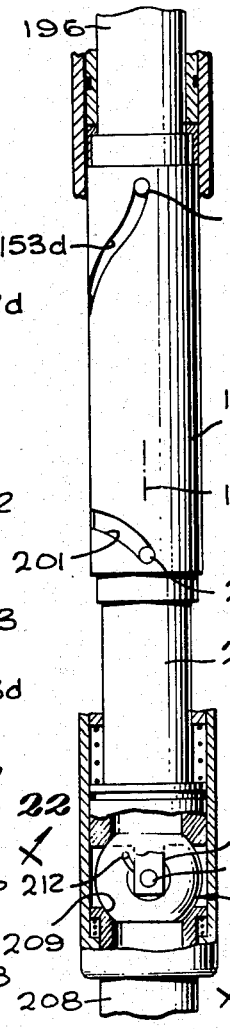
FIG. 20 is a somewhat diagrammatic representation of the cam mechanism of FIG. 18, taken primarily on line 20—20 of FIG. 18.
Figure 21:
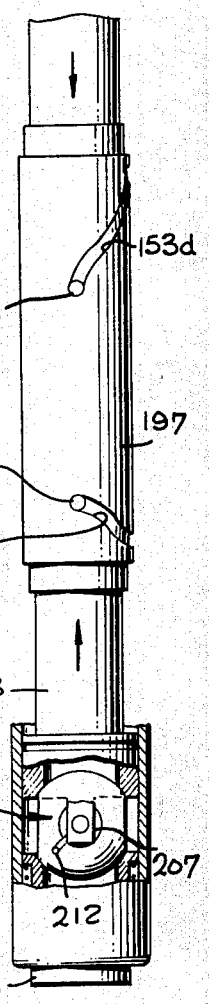
FIG. 21 shows the FIG. 20 cam mechanism in the closed valve condition.

Near its lower end, cam tube 197 contains one or more additional cam slots 201, which may be shaped as illustrated in FIGS. 20 and 21 and receive as many outwardly projecting cam pins 202 carried by a lower vertically movable tube 203. This tube has an annular valve seat surface 204 near its lower end, which annularly engages the ball valve 187, with the ball being mounted for pivotal movement relative to tube 203 about a horizontal axis 205 by means of two mounting pins 206 carried by a pair of downwardly projecting diametrically opposite arms 207 formed at the lower end of tube 203. A lower seat element 208 may be formed as a tube, as shown, and have a valve seat surface 209 annularly engageable with ball 187. A coil spring 210 yieldingly urges seat element 208 upwardly against the ball, to form an effecitve annular seal therewith. An O-ring or other deformable seal ring 211 forms an annular seal between tube 203 and outer body part 191 at a location above the ball valve.

A pin 212 carried by lower body section 191 projects into a recess 213 in ball 187, at a location offset from pivotal axis 205, and in a relation to cause rotary movement of the ball between open and closed positions in response to vertical movement of tube 203 and the ball. For equalizing the pressure between the inside and outside of the tool body, there may be provided near the upper end of the tool body one or more spring pressed equalizing valves **179*d* corresponding to valves 179 of FIG. 7.**

Figure 18:
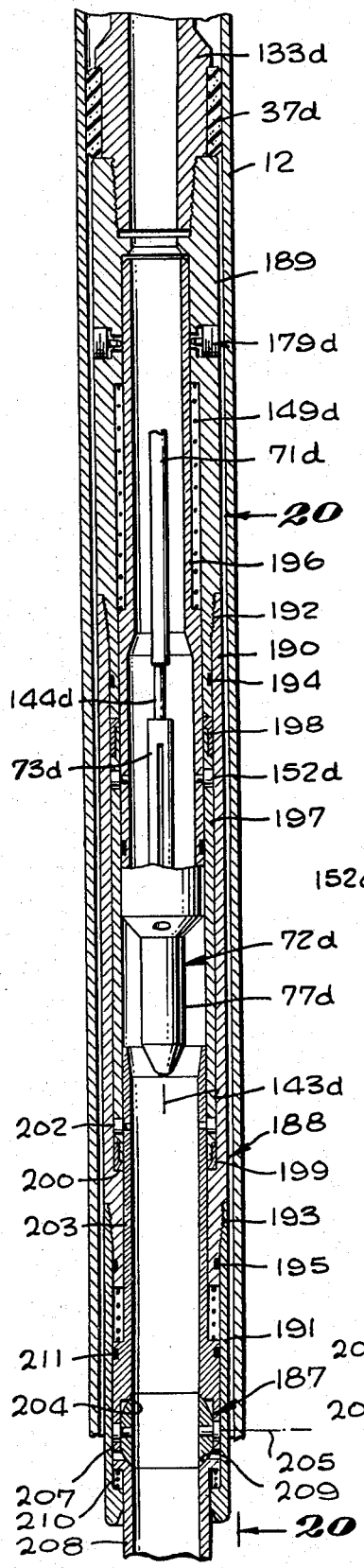
FIG. 18 is a vertical section similar to FIG. 7 and the left-hand portion of FIG. 2, showing the form of safety valve which is covered by the present divisional application.
Figure 19:
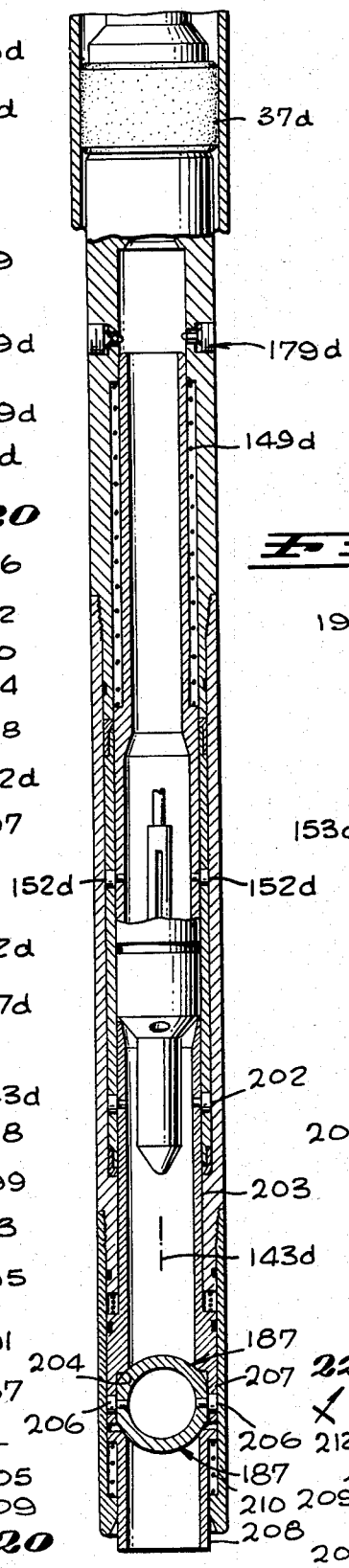
FIG. 19 shows the valve of FIG. 18 in closed condition.
Figure 22:
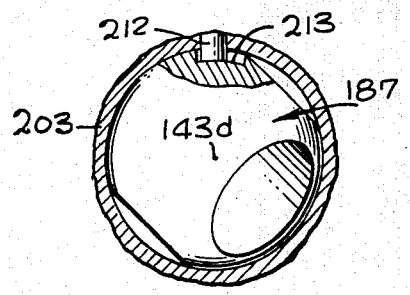
FIG. 22 is a section taken on line 22—22 of FIG. 20.

In using the valve assembly of FIG. 18, this assembly is first lowered into a well to a desired subsurface location with a connected landing and sealing unit such as for example that shown at 18 in FIG. 2, and that unit is then actuated to secure and seal the unit in the well at that position. The cable, landing weight, rod **71*d*, and carried connector parts 144*d* and 73*d* are then lowered into the well and connected to the other half 77*d* of disconnect 72*d*, in the condition illustrated in FIG. 19. The cable is then pulled upwardly and fastened in tensioned condition by apparatus such as that shown in the right-hand portion of FIG. 2, or as shown in FIG. 5, or by other appropriate means, to raise tube 196 against the tendency of spring 149 from the FIG. 19 position to the FIG. 18 position. As brought out best in FIGS. 20 and 21, this upward movement of tube 196 acts through cam elements 152*d* and 153*d* to cause rotation of tube 197 about the vertical axis of the tool, and that rotation is then reconverted by cam elements 201 and 202 to downward movement of lower tube 203, ball 187 and bottom seat element 208. Upon such downward movement, pin 212 acts to turn ball 187 about axis 205 from the closed position of FIGS. 19 and 21 to the open position of FIGS. 20 and 22, in which position the valve is thereafter retained by the tensioned condition of the cable until conditions occur which release the cable and allow automatic closure of the valve by spring 149*d*.**

While certain specific apparatus embodying the present invention has been disclosed as typical, the invention is of course not limited to the particular structure disclosed, but rather is applicable broadly to all such variations as fall within the scope of the appended claims.

We claim:

1. Well safety apparatus comprising a safety valve adapted to be lowered into a well and actuable between an open condition for passing production fluid upwardly through said well and a closed condition shutting off such fluid flow, and an elongated actuating element to extend upwardly from said valve through the well toward the surface of the earth and adapted to be moved longitudinally upwardly from its upper end and acting in response to said longitudinal movement to cause actuation of said valve between said two conditions thereof, said safety valve including a body, a ball valve element carried by said body and mounted to turn about a generally horizontal axis between open and closed positions, motion reversing means for displacing said ball valve element downwardly in response to upward movement of said actuating element, and means for turning said ball valve element from one of said positions to the other in response to said downward movement thereof.

2. Well safety apparatus as recited in claim 1, in which said motion reversing means includes a part mounted to turn about a vertical axis, first cam means for turning said part about said vertical axis in response to upward movement of said actuating element, and second cam means for actuating said ball valve elememt downwardly in response to turning movement of said part about said vertical axis.

3. Well safety apparatus comprising a safety valve adapted to be lowered into a well and actuable between an open condition for passing production fluid upwardly through said well and a closed condition shutting off such fluid flow, and an elongated actuating element to extend upwardly from said valve through the well toward the surface of the earth and adapted to be moved longitudinally from its upper end and acting in response to said longitudinal movement to cause actuation of said valve between said two conditions thereof, said safety valve including a tubular vertically extending body, a first tube in said body mounted for relative upward and downward movement, a spring yieldingly urging said tube downwardly relative to the body, a connection for securing said tube to said actuating element, a tubular part mounted to turn within the body about an essentially vertical axis, first cam means for turning said tubular part about said vertical axis in response to upward movement of said tube, a ball valve element containing a fluid passage and mounted to turn about a generally horizontal axis between open and closed positions, an additional tube, means mounting said ball valve element to said additional tube to turn about said horizontal axis relative thereto, second cam means for displacing said additional tube downwardly in response to turning movement of said tubular part about said vertical axis, and a lug carried by said body and interfitting with said ball valve element in a relation turning the ball valve element from closed to open position in response to downward movement of said additional tube and the ball valve element.

4. Well safety apparatus as recited in claim 3, including an annular seat surface near the lower end of said additional tube and annularly engaging said ball valve element, and a lower seat element annularly engaging an underside of said ball valve element and spring pressed upwardly relative to said body.

* * * * *